United States Patent [19]

Lamer et al.

[11] 4,238,036

[45] Dec. 9, 1980

[54] HATCH COVER CRANE

[75] Inventors: Gerald P. Lamer; Arnold Petersen; Norbert W. Lenius, all of Sturgeon Bay, Wis.

[73] Assignee: Marine Travelift, Inc., Sturgeon Bay, Wis.

[21] Appl. No.: 953,626

[22] Filed: Oct. 23, 1978

[51] Int. Cl.[3] ..... B66C 23/52

[52] U.S. Cl. ..... 212/147; 105/163 SK; 254/86 H; 212/189; 212/166; 212/208

[58] Field of Search ..... 212/3 R, 4, 5, 6, 11, 212/10, 13; 414/140, 459, 460; 114/75, 201 R; 105/163 R, 163 SK; 254/86 R, 86 H; 180/6.48, 6.5, 8 R; 239/212

[56] References Cited

U.S. PATENT DOCUMENTS

| | | | |
|---|---|---|---|
| 2,700,426 | 1/1955 | Harless | 254/86 R |
| 3,061,109 | 10/1962 | Stone | 212/4 |
| 3,166,023 | 1/1965 | Lynd, Jr. | 105/163 R |
| 3,262,580 | 7/1966 | Markowitz | 212/13 X |
| 3,776,169 | 12/1973 | Strecker | 114/75 X |
| 3,861,534 | 1/1975 | Birdwell | 212/3 |

FOREIGN PATENT DOCUMENTS

| | | | |
|---|---|---|---|
| 237522 | 12/1962 | Austria | 254/86 H |

*Primary Examiner*—Sherman D. Basinger
*Attorney, Agent, or Firm*—Jr. August E. Roehrig

[57] ABSTRACT

A hatch cover crane having a hydraulically actuated jack assembly for realigning a hatch cover carried by the hatch cover crane with a ship's cargo hold opening. The jack is extended downward onto one of a pair of support rails, over which the hatch cover crane is moved, to raise one end of the hatch cover crane off the rails. While one end of the crane is raised off the rails, an opposite end is freely driven to facilitate alignment of the hatch cover carried by the hatch cover crane with the cargo hold opening.

11 Claims, 11 Drawing Figures

HATCH COVER CRANE

BACKGROUND OF THE INVENTION

This invention relates in general to hatch cover cranes and, in particular, to a hatch cover crane having a hydraulically actuated jack to facilitate a hatch cover carried by the hatch cover crane being easily realigned over a cargo hold opening, as necessary.

More specifically, but without restriction to the particular use which is shown and described, this invention relates to a hatch cover crane having a hydraulically actuated jack wherein the jack is actuated to lift one end of the hatch cover crane off its support track to facilitate realigning the hatch cover carried by the hatch cover crane with the cargo hold opening, as necessary.

Generally, in cargo carrying ships, there are spaced openings along the top of the deck which are called cargo hold openings, or hatches. Various types of bulk materials are conveyed through these hatches into the ship's hold for transport across the sea.

In order to protect the cargo contained within the ship's hold from the adverse elements of the weather encountered during a voyage, there is a need for a closely-fitted covering over these hatches or openings, commonly called hatch covers. To provide adequate protection for the cargo, as well as to protect the safety of the ship during inclement weather, these hatch covers are made of a strong, heavy and durable metal. The use of such a heavy metal renders the hatch cover extremely bulky and causes difficulty in removing the hatch cover from the cargo hold opening. Due to their excessive weight and bulk, it is dangerous and inefficient to employ deckhands to manually remove or replace these covers.

Therefore, in order to safely and conveniently remove these hatch covers a hatch cover crane is used. In operation, the hatch cover crane is positioned directly over the hatch covers to provide an easy, efficient, and safe way to remove the hatch cover from the cargo hold opening. Since ships normally have a number of cargo hold openings in their deck, the hatch cover crane must be easily movable along the deck of the ship in order to be positionable over each hatch cover. For example, the hatch cover crane can be supported upon tracks or rails which are positioned on opposite sides of the hatches and extend a sufficient length to enable the crane to be positioned over each one of the cargo hatches.

An operator stationed upon the hatch cover crane itself can operate the crane to safely and efficiently remove the hatch covers. The operator positions the hatch cover crane directly over the hatch cover and a pair of hatch engaging hooks are lowered downward beneath the hatch crane. The hatch cover crane is then driven until the lowered hooks engage eyelets on the hatch cover. When the hooks engage the eyelets, the hooks are retracted thereby lifting the cover. In order to safely secure the hatch cover when in its raised position, surrounding each hook there is a rectangular hatch cover stop, laterally positioned to prevent the hatch cover from any oscillatory movement. The hatch cover stop is a safety device that secures the hatch cover to the hatch cover crane and prevents movement of the hatch cover caused by wind or wave motion of the water.

Due to the fact that the hatch cover crane may become out of alignment after running for a period of time, misalignment between the hatch cover crane and the cargo hold openings will occur. Thus, as the hatch cover crane, which is carrying the hatch cover, rolls along the tracks and is positioned over a cargo hold, the hatch cover may not be correctly aligned with the cargo hold opening.

In order to replace the hatch cover upon the cargo hold opening, it is important that the alignment between the hatch cover carried by the hatch cover crane and the cargo hold opening remain quite close due to the close fit of the hatch cover on the hatch opening. Cover alignment and fit with the cargo hold opening are very important both to protect the cargo and to maintain the seaworthiness of the ship. While every effort is made to maintain the alignment of the hatch cover carried by the hatch cover crane with the cargo hold openings, for the reasons previously discussed it is difficult to maintain.

The hatch cover crane described herein includes a hydraulic jack on one side of the hatch cover crane, and mounted between the crane wheelbase just above one of the support tracks or rails which extend substantially the length of the ship. The jack elevates one end of the crane above the track to allow the operator to drive the opposite end of the hatch cover crane forward or backward to align the hatch cover carried by the hatch cover crane with the hatch or cargo hold opening thereby effecting parallelism with the cargo hold openings.

SUMMARY OF THE INVENTION

It is, therefore, an object of this invention to improve hatch cover crane assemblies.

Another object of this invention is to facilitate alignment of a hatch cover carried by a hatch cover crane with a cargo hold opening.

A further object of this invention is to maintain alignment between a hatch cover carried by a hatch cover crane and a cargo hold opening through operation of a hydraulically actuated jack assembly which lifts the hatch cover crane to facilitate repositioning.

These and other objects are attained in accordance with the present invention wherein there is provided a hatch cover crane having a hydraulically actuated jack assembly attached thereto to permit realignment of the hatch cover carried by the hatch cover crane with the cargo hold opening.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF A PREFERRED EMBODIMENT OF THE INVENTION

Figure 1:
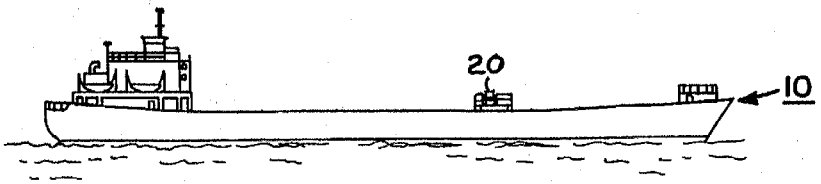
FIG. 1 is a perspective view of a ship which may utilize a hatch cover crane constructed according to the invention.
Figure 2:
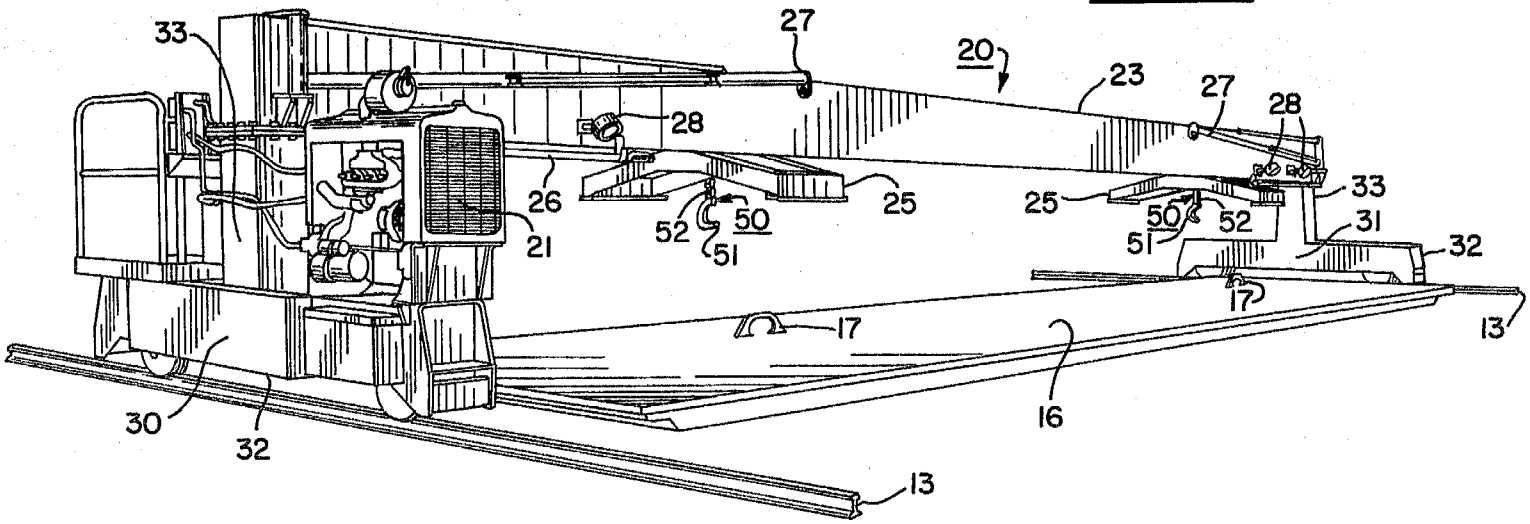
FIG. 2 is a frontal perspective view of a hatch cover crane constructed according to the invention.

Referring now to the drawings, in FIG. 2 there is shown a hatch cover crane 20 used to remove hatch covers 16 from cargo hold openings 12 of a ship 10, shown in FIG. 1. Generally such ships have a number of cargo hold openings 12, spaced throughout the length of the ship 10, and have a pair of longitudinally extending parallel rails 13 forming a track upon which the hatch cover crane 20 is supported. An operator stationed upon the hatch cover crane 20 controls actuation of a motor 21 which propels the hatch cover crane 20 along the tracks 13 and is used to raise and lower a pair of hoisting assemblies 50 in a manner to be hereinafter described in detail.

Figure 5:
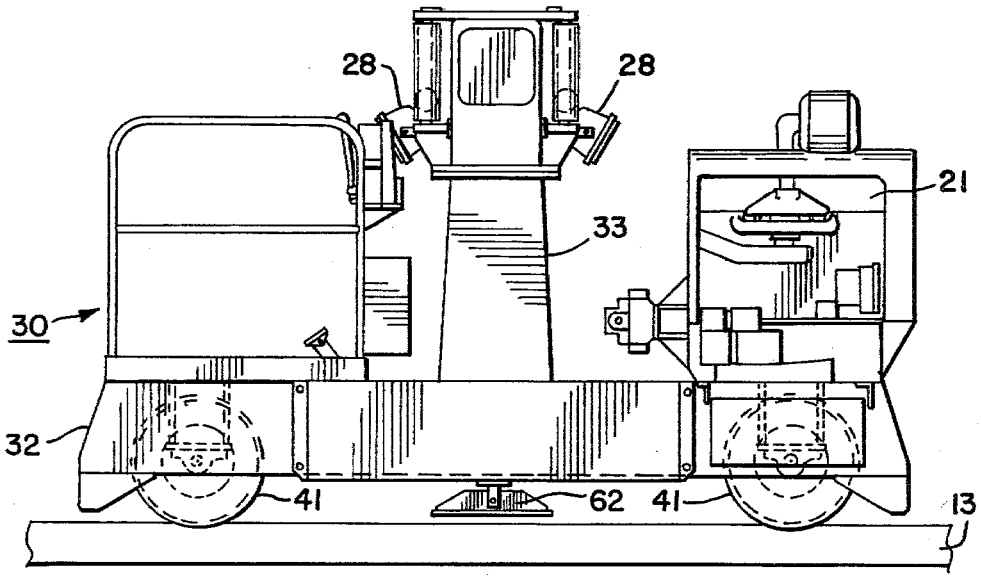
FIGS. 5 and 6 are opposite side end views of a hatch cover crane such as illustrated in FIG. 2 with portions removed to better illustrate the features thereof.

The hatch cover crane 20 includes two laterally spaced and similar end frames 30 and 31 which are connected by a transversely extending top support beam 23. Basically, the end frames 30 and 31, best shown in FIGS. 5 and 6, include a horizontally extending cross beam 32, wherein wheel assemblies 41 are rotatably journaled to allow the hatch cover crane 20 to move along the support tracks 13, and a vertically extending support 33 connected at its uppermost end to the top support beam 23 which extends therebetween.

Figure 6:
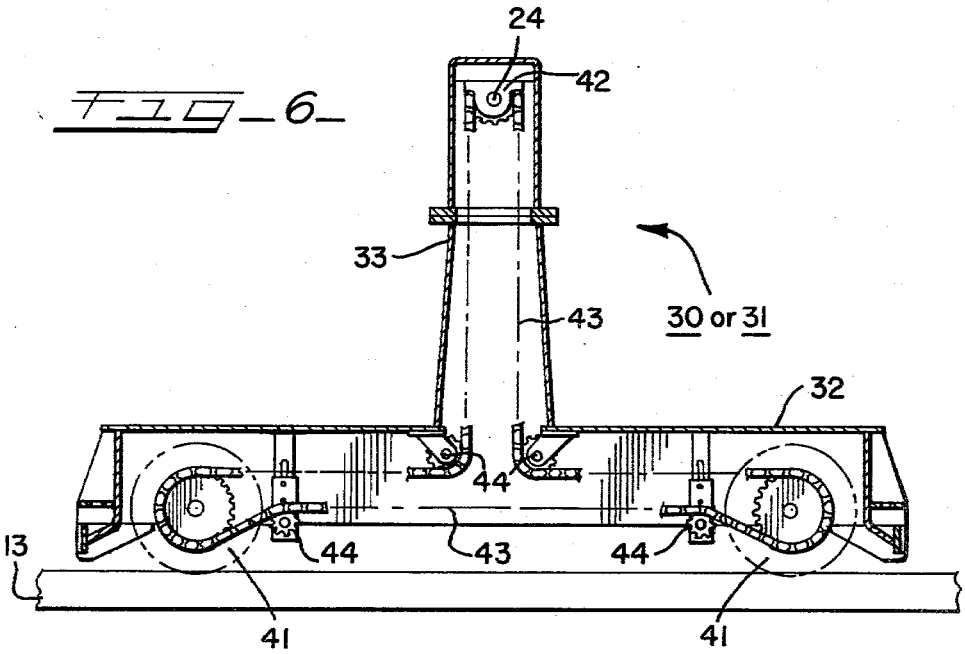

In order to move the hatch cover crane 20 along the support rails 13, each end frame 30 and 31 is provided with a drive sprocket 42 (as best shown in FIG. 6), suitably journaled in the end portions of the top support beam 23. The drive sprockets 42 are each connected to an end of a rotatable drive shaft 24 which extends the entire length of and is rotatably supported within the top support beam 23, to allow all four wheels to be driven by a mechanically balanced drive. While the hatch cover crane 20 preferably uses a diesel driven hydraulic pump 21, mounted on an end frame 30 upon which the operator is stationed, to provide power to drive shaft 24, other suitable power sources could be used.

Each drive sprocket 42 is rotatably journaled in the end portions of the top support beam 23, and is rotatably driven by an endless drive chain 43 passing thereabout and over a series of idler sheaves 44, which are mounted on the horizontally extending cross beam 32, and about drive sprockets 42 which are thereby operatively connected to each of the two wheels 41.

When the hatch cover crane 20 is properly aligned over a hatch cover 16 the hoist chain and hook assembly 50, which includes a pair of hatch engaging hooks 51, is used to remove the hatch cover 16. The hoist chain and hook assemblies 50 (best shown in FIGS. 2 and 4), are carried by the top support beam 23 of the hatch cover crane 20 by means of a hoist chain 52. The hoist chain and hook assembly 50, which utilizes a typical pulley system, is movable up and down in a vertical plane and includes the pair of hooks 51 which are lowered and then engaged with a pair of eyelets 17 which are carried by the hatch cover 16 by moving the hatch cover crane 20 relative to the hatch cover 16. The hatch cover 16 is constructed such that the pair of eyelets 17 are positioned to allow the hooks 51 to be easily engaged therein when the hatch cover crane 20 is driven forwardly over the hatch cover 16.

Figures 7, 8, 9:
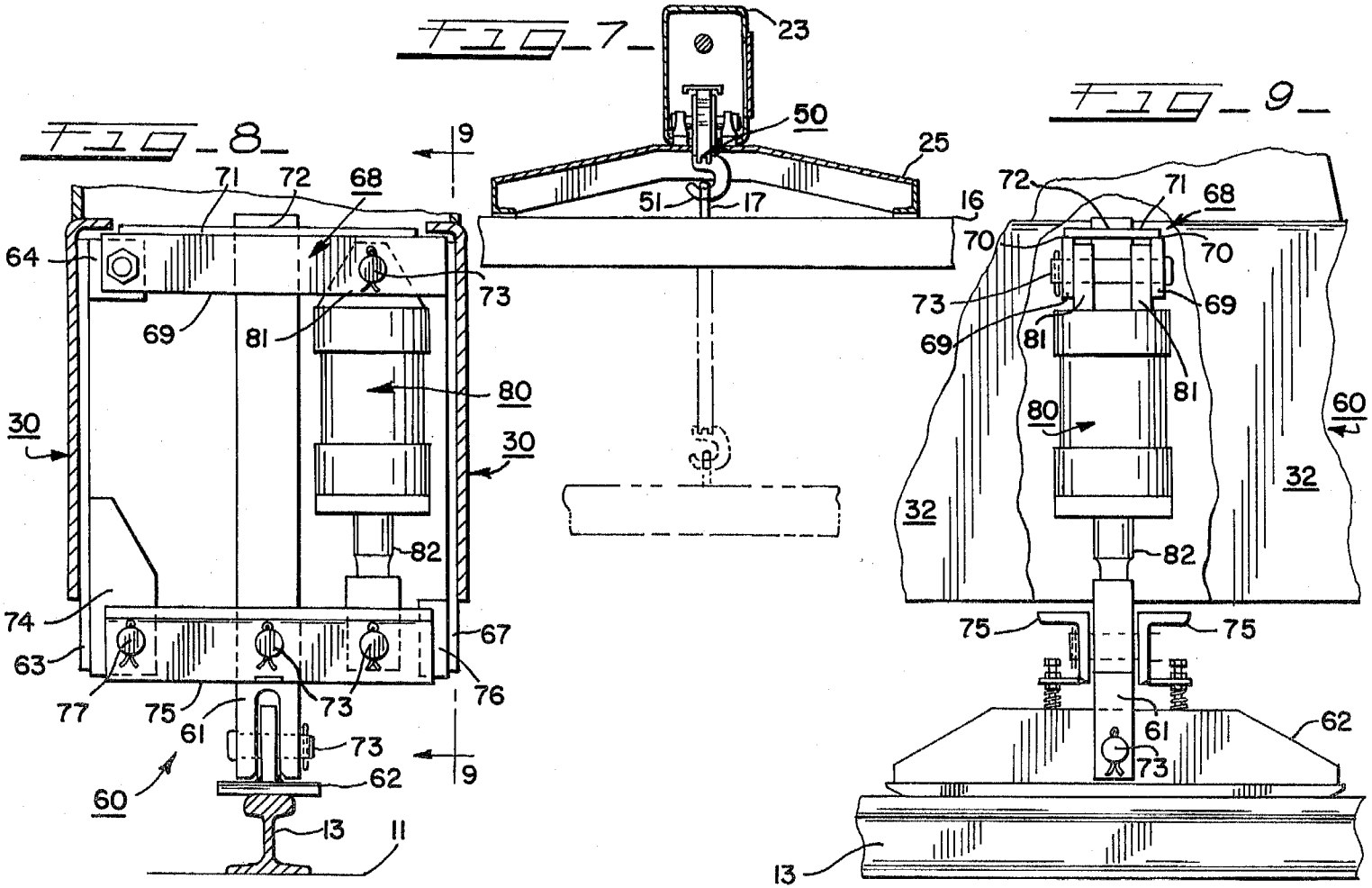
FIG. 7 is a partial section view taken along line 7—7 of FIG. 4.
FIG. 8 is an enlarged front view of a jack assembly used to elevate an end of the hatch cover crane.
FIG. 9 is an end view of the jack assembly of FIG. 8 taken along lines 9—9 with portions broken away to better illustrate the features thereof.

When an operator raises the hoist chain and hook assembly 50, the hatch cover 16 is lifted off the cargo hold opening 12 in an upward direction until it contacts a pair of hatch cover stops 25. The hatch cover stops 25, as best shown in FIG. 7, function to set a maximum height that the hatch cover 16 will attain, and maintain the hatch cover 16 in a stable position to prevent any oscillatory movement from wind or wave forces.

Figure 3:
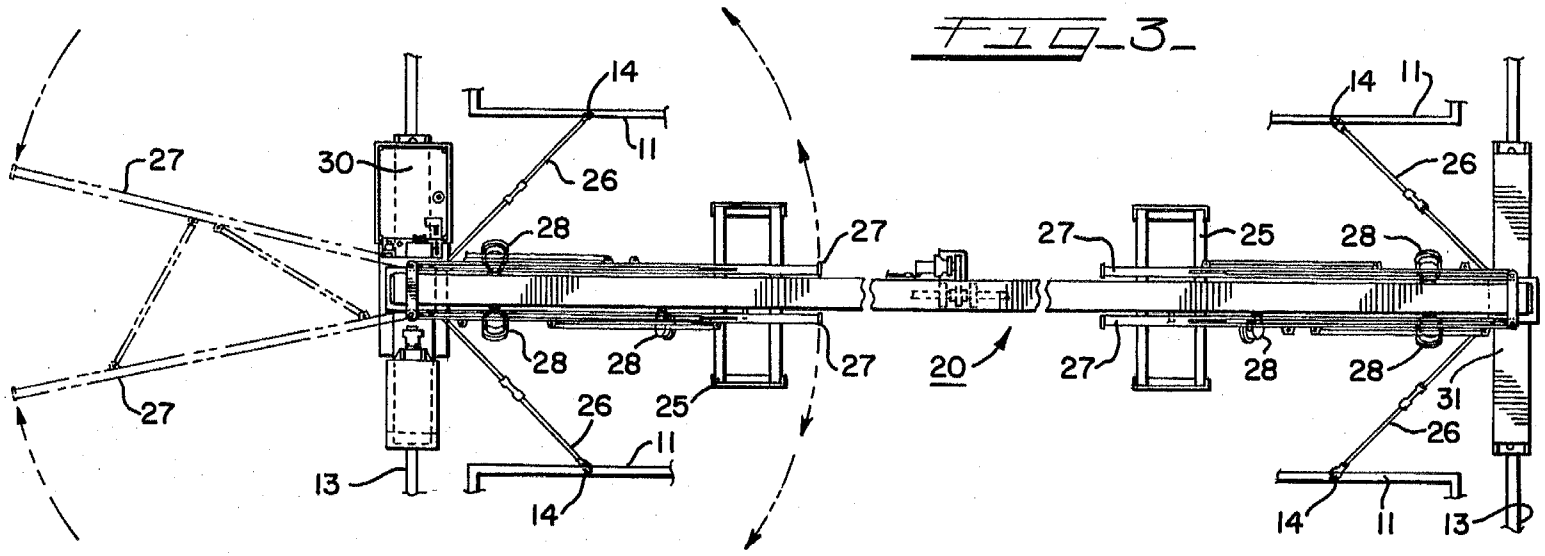
FIG. 3 is a top horizontal view of a hatch cover crane, such as illustrated in FIG. 2.
Figure 4:
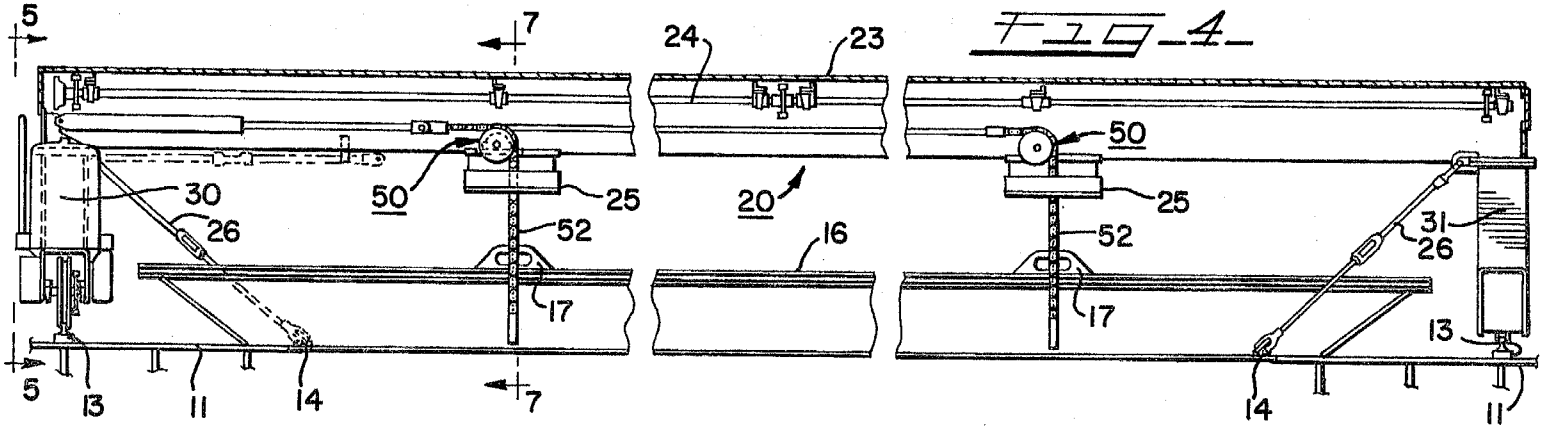
FIG. 4 is a front horizontal view of a hatch cover crane such as illustrated in FIG. 2.

In order to prevent the hatch cover crane 20 from rolling while the hatch cover crane 20 is not in use or is being stored, the hatch cover crane 20 has four tie-down struts 26. The tie-down struts 26 are pivotally secured to and are extendable outwardly from the vertical support 33 of each end frame 30 and 31. The tie-down struts 26 are pivotal from a stored position adjacent to the top support beam 23 (whereat they are secured to the top support beam 23) to a lateral and downward position for securing to the ship's deck 11 by appropriate hooks 14, as shown in FIGS. 3 and 4.

To provide lighting during operation of the hatch cover crane 20, and to allow visual inspection of the interior of the cargo holds, six floodlights 28 are attached to the top support beam 23 of the hatch cover crane 20. In addition, and to carry out various shipboard operations, each end frame 30 and 31 has a pair of outriggers 27 secured adjacent to each end of the top support beam 23. The outriggers 27 are extendable laterally outward over the side of the ship in a substantially horizontal plane, about a vertical axis, to support a scaffold or other such apparatus for cleaning or painting the sides of the ship.

Figure 2A:
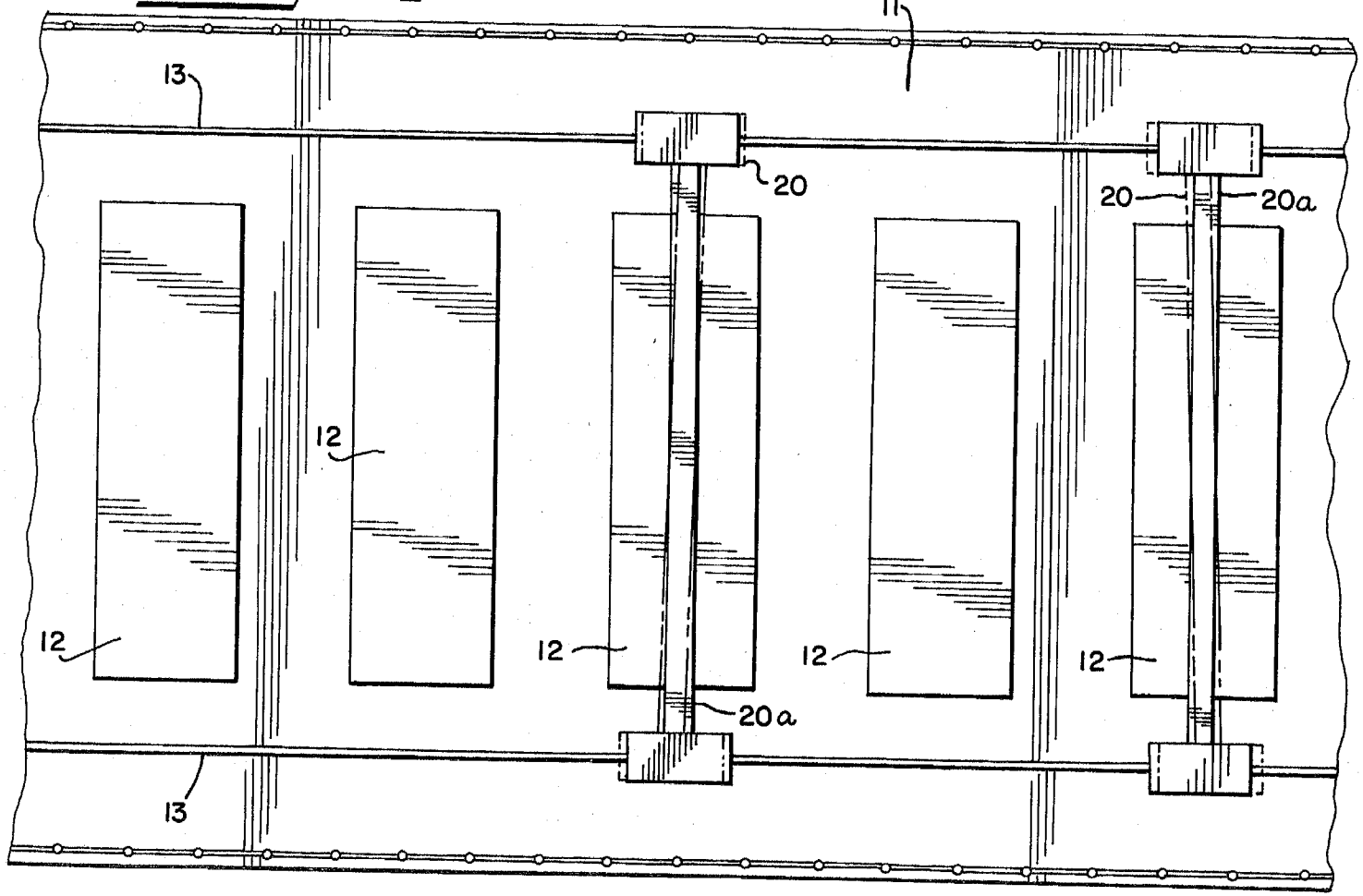
FIG. 2A is a mechanical schematic of a ship's deck to better illustrate the manner in which the hatch cover crane is positioned over a cargo hold opening.

For a better understanding of the positioning required to align the hatch cover 16 carried by the hatch cover crane 20 over the cargo hold openings 12, FIG. 2A is an exaggerated mechanical schematic of a ship's deck 11, which illustrates the hatch cover crane 20 in and out of alignment with the cargo hold openings 12. When the operator moves the hatch crane 20 (shown by the broken lines in FIG. 2A) upon the tracks or rails 13, which are secured alongside the cargo hold openings 12, the hatch cover crane may become out of alignment after a period of use. In order to assist the operator in aligning the hatch cover 16 carried by the hatch cover crane 20 with the cargo hold opening 12, there is provided a hydraulically actuated jack assembly 60 (best shown in FIGS. 8 and 9) attached to the end frame 30 (where the operator is stationed) and positioned midway between the wheelbase of the end frame 30. Since the hatch cover 16 carried by the hatch cover crane 20 and cargo hold opening 12 must be correctly aligned in order to replace the hatch cover, the jack assembly 60 is used to raise the wheels 41 carried by end frame 30 off of the support tracks or rails 13. While one pair of the wheels 41 are held in an elevated position, the motor 21 is used to drive the wheels on the opposite side end frame 31, either forward or in reverse, to properly align the hatch cover crane **20*a* (shown properly aligned by the solid lines in FIG. 2A) and, therefore, the hatch cover 16 with the cargo hold opening 12**.

Referring to FIGS. 8 and 9, the jack assembly 60 includes, generally, a jack shaft or post 61, a jack shoe 62, a hydraulic cylinder and rod arrangement 80, and support brackets 63, 67 and 68 which secure the jack assembly 60 in position to permit pivotal movement of certain elements as hereinafter described in detail.

The jack assembly 60 is secured inside the end frame 30 of the hatch cover crane 20 by means of a vertically extending side support bracket 63 and a vertically extending hydraulic support bracket 67 which are in spaced parallel position adjacent to opposite sides of the end frame 30. In order to rigidly support the jack assembly 60, there is provided a top support bracket assembly 68 which extends between the top portions of brackets 63 and 67. The assembly 68 is fixedly secured to the hydraulic support bracket 67 at one end and connected to the side support bracket 63 in a manner hereinafter described in detail.

The top support bracket assembly 68 comprises three members, two parallel horizontally extending side members 69 disposed on either side of a vertically extending jack shaft 61 which extends throughout the height of the jack assembly 60 (as best shown in FIG. 8), and a top guide member 71 laterally disposed in a flat position and of a width sufficient to be secured to both side members 69. The top guide member 71 is welded to the top edges 70 of the side members 69 to form the top of support bracket assembly 68 and is formed with an aperture 72 to provide a guide for the movement of the jack shaft 61.

The end of the top support bracket assembly 68, which is opposite to its fixed connection to hydraulic support bracket 67, is secured to a flange 64 which extends outwardly from the uppermost portion of the side support bracket 63. During assembly of the jack assembly 60, this end of the top support bracket assembly 68 is bolted to the flange 64 to facilitate accurate location of the parts and to allow for manufacturing tolerances. After the side support bracket 63 and the top support bracket assembly 68 are properly located, this bolted connection is welded together as one piece thereby fixedly connecting brackets 63 to the assembly 68 for maintaining the upper portion of the jack assembly 60 in a fixed position.

In order to lift the hatch cover crane 20 from the support rail 13, the jack assembly 60 is provided with a jack shoe 62 which is carried by the lowermost and bifurcated end of jack shaft 61 in a position to contact the support track 13. The jack shaft 61 extends in a vertical direction through the guide hole 72 in the top guide member 71 of the bracket assembly 68 and is connected to the jack shoe 62 by means of a clevis pin and cotter arrangement 73. The guide hole 72 maintains the jack shaft 61 in a vertical position by supporting the shaft during vertical movement.

In order to secure the lower portion of the jack assembly 60 to the side support bracket 63, a pair of angle supports 75 with portions extending parallel to each other are connected at one end to a flange 74, which is fixedly secured to and extends outwardly from the lower part of the side support bracket 63. The angle supports 75 are pivotally connected to the flange 74 by means of a clevis pin and cotter arrangement 77 for a purpose to be hereinafter described. The angle supports 75 extend on each side of the lower end of the jack shaft 61, and are connected to the jack shaft 61 by means of a clevis pin and cotter arrangement 73. For assistance in maintaining the jack shaft 61 in a vertical position, there is provided a guide flange 76 extending outward from the lowermost part of the hydraulic support bracket 67 and positioned between free ends of the angle supports 75 to guide their movement together with that of the jack shaft 61. In this manner pivotal movement of the pair of angle supports 75 will effect vertical movement of the jack shaft 61 and jack shoe 62.

To effect pivotal movement of the pair of angle supports 75, a commercially available hydraulic cylinder and rod assembly 80 is connected at one end to the angle supports 75 and at the opposite end to the top support bracket assembly 68. In order for the jack shaft 61 to move downward until the jack shoe 62 contacts the support track 13 to elevate the operator's side end frame 30 off the track 13, a bracket 81 is secured to the top of the hydraulic cylinder and rod assembly 80. This bracket 81 extends upwardly between the side members 69 of the top support bracket assembly 68 and is secured thereto by a clevis pin and cotter arrangement 73. A cylinder rod 82 of the hydraulic cylinder and rod assembly 80 is similarly attached at its free end to the angle supports 75. The cylinder rod 82 extends and retracts in a vertical direction which, in turn, moves the jack shaft 61 up and down through the mechanical coupling with angle brackets 75. As the cylinder rod 82 is extended downward the angle supports 75 pivot clockwise (FIG. 8) thereby allowing the jack shoe 62 to be lowered onto the support track 13 to elevate one side of the hatch cover crane 20.

In operation of the jack assembly 60 previously described, the hatch crane operator can actuate the hydraulic jack assembly 60 by manually actuating a control valve 91 in the desired direction to raise or lower the jack shoe 62. When the control valve is actuated to lower the jack shoe 62 onto the track 13, the operator's side end frame 30 of the hatch cover crane 20 is raised about ¼" above the support track 13. The operator's side end frame 30 is thereby fixed in a stationary position, which will allow the other end frame 31 to be freely driven, either forward or back, to permit the hatch cover 16 carried by the hatch cover crane 20 to be aligned with the cargo hold opening 12 to insure that the hatch cover 16 is positioned directly over the cargo hold opening 12.

Figure 10:
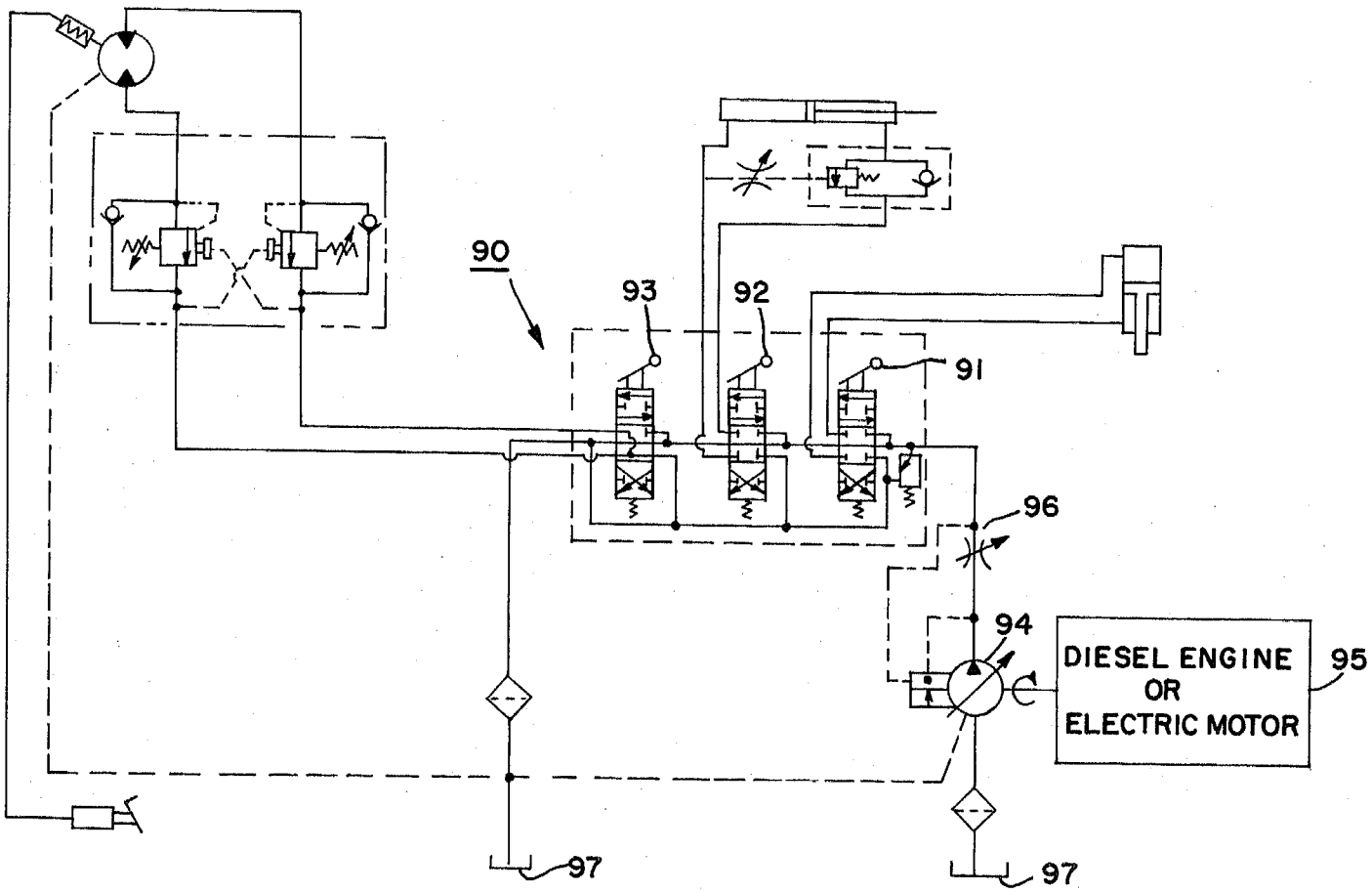
FIG. 10 is a schematic diagram of the hydraulic system which controls the various movements and functions of the hatch cover crane of FIG. 2.

Turning to the hydraulic system 90, schematically shown in FIG. 10, the hydraulic system employs a typical variable output hydraulic pump 94, driven by either a diesel engine or an electric motor 95, a volume control valve 96, three control valves 91, 92 and 93, and a sump or reservoir 97. At the output of the variable pump 94, the volume control valve 96 acts to regulate the flow of fluid from the pump 94 through the system 90. The three control valves 91, 92 and 93, when actuated, will operate the jack assembly 60, the hoist chain and hook assembly 50, and drive the hatch cover crane 20 either forward or back.

For a better understanding of the operation of the hatch cover crane 20 previously described, the aligning operation will be hereinafter described. In operation, the operator lowers the hoist chain and hook assembly 50 (by actuating the hoist chain and hook assembly control valve 92). The operator then drives the hatch cover crane 20 either forward or backward by actuating a hydraulic drive control valve 93 until the hooks 51 are engaged with the hatch cover eyelets 17. The operator then raises the hoist chain and hook assembly 50 by actuating the hydraulic hoist chain and hook assembly control valve 92 thereby lifting the hatch cover 16 until it contacts the hatch cover stops 25. The hatch cover 16 is then held in a stable position. The hatch cover crane 20 can then be driven away securely carrying the hatch cover 16 to allow easy access to the ship's hold.

When it is desired to replace the hatch cover 16 upon the cargo hold opening 12, the operator drives the hatch cover crane 20, which is carrying a hatch cover 16 secured against the hatch cover stops 25, into a position substantially over the cargo hold opening 12. The operator then actuates the hoist chain and hook assembly control valve 92 thereby lowering the hatch cover 16 to a position just above the cargo hold opening. Due to the fact that the hatch cover 16 must be closely fit over the cargo hold opening 12, the operator makes a visual inspection of the alignment of the hatch cover 16 carried by the hatch cover crane 20 and the cargo hold opening 12 to determine if realignment is necessary. In the event that realignment is required the operator will align the hatch cover 16 with the cargo hold opening 12 at the operator's end of the hatch cover crane 20. The operator then actuates the hydraulic jack control valve 91 which lowers the jack shoe 62 onto the support tracks 13 and lifts the operator's side end frame 30 therefrom. The operator then actuates the hydraulic drive control valve 93 to move the opposite end frame 31 along the opposite track 13 to correctly align the other end of the hatch cover 16 carried by the hatch cover crane 20 with the cargo hold opening 12. After proper alignment is attained, the operator retracts the jack shoe 62 by actuating the hydraulic jack control valve 91, lowering the end frame 30 back onto the support track 13. The hatch cover 16 is lowered onto the cargo hole opening 12 and properly secured, and the operator can go on to another cover.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hatch cover crane for removing a hatch cover from a cargo hold opening of a ship including, support means for operative engagement with a hatch cover positioned upon a cargo hold opening to form a removable cover therefore, said support means extending a width greater than the width of the hatch cover, lifting means carried by said support means for engaging the hatch cover to remove and replace the hatch cover on the cargo hold opening, drive means operatively connected to said support means for moving said support means relative to the cargo hold opening and hatch cover positioned thereover, and aligning means for elevating one end of said support means and thereby fixedly securing said one end of said support means and allowing an opposite end of said support means to be moved relative to said elevated fixed end by operation of said drive means for facilitating aligning said lifting means over the cargo hold opening for removal and replacement of the hatch cover on the cargo hold opening.

2. The apparatus of claim 1 wherein said support means comprises at least two laterally spaced end frames, and a top support beam extending transversely between and carried by the top of said end frames.

3. The apparatus of claim 2 wherein said lifting means is supported for vertical movement from said top support beam and comprises a pulley and hoist chain having a depending hook assembly for engaging the hatch covers positioned upon the cargo hold opening of a ship.

4. The apparatus of claim 2 wherein a portion of said drive means is carried within each of said end frames of the support means and includes a wheel assembly supporting each end frame and a drive sprocket operatively driven by a drive chain for rotatably driving said wheel assemblies to effect movement of said support means.

5. The apparatus of claim 4 wherein said aligning means comprises a jack assembly including a vertically movable jack shaft connected to a jack shoe to elevate one of said laterally spaced end frames relative to the other for operatively disengaging one of said wheel assemblies from effecting movement of the end frame supported thereby.

6. The apparatus of claim 5 wherein said end opposite to said elevated end is driven in an arcuate path of movement relative to said elevated end for effecting alignment of said lifting means with the hatch cover.

7. The apparatus of claim 2 further including tie-down struts pivotally secured to the top of each of said end frames and pivotable outwardly in a lateral and downward direction to be secured in a fixed position for maintaining the hatch cover crane in a fixed position during storage.

8. The apparatus of claim 1 further including hatch cover stop means secured to said support means to prevent oscillatory movement of the hatch cover after removal from the cargo hold opening.

9. A hatch cover crane for removing a hatch cover from a cargo hold opening of a ship including, support means comprising at least two laterally spaced end frames and a top support beam extending transversely between and carried by the top of said end frames for operative engagement with a hatch cover positioned upon a cargo hold opening to form a removable cover therefore, said support means extending a width greater than the width of the hatch cover, lifting means carried by said support means for engaging the hatch cover to remove and replace the hatch cover on the cargo hold opening, drive means operatively connected to said support means for moving said support means relative to the cargo hold opening and hatch cover positioned thereover, and comprising a jack assembly including a vertically movable jack shaft connected to a jack shoe for elevating one of said laterally spaced end frames relative to the other for fixedly securing one end of said support means and allowing an opposite end of said support means to be moved relative to said fixed end by operation of said drive means for facilitating aligning said lifting means over the cargo hold opening for removal and replacement of the hatch cover on the cargo hold opening.

10. A method of aligning a hatch cover crane with a hold opening of a ship comprising the steps of moving a hatch cover crane which extends a length greater than the longitudinal length of the hatch cover and includes lifting means connected to the hatch cover, over a cargo hold opening into a position substantially in alignment with the longitudinal center line of the cargo hold opening, fixedly securing one end of the hatch cover crane relative to the hatch cover by elevating one end of the hatch cover crane to operatively disengage said end from propelling movement, and moving the opposite end of the hatch crane in an arcuate path of movement to effect alignment of the lifting means with the cargo hold opening.

11. The method of claim 10 wherein the step of elevating one end of the hatch cover crane comprises lowering a jack shaft, operatively connected within one end of the hatch cover crane and having a jack shoe connected to its free end, in downward vertical direction thereby elevating one end of the hatch cover crane relative to the other.

* * * * *